United States Patent [19]

Szabo

[11] 4,300,677

[45] Nov. 17, 1981

[54] ELECTRIC MOTOR SHIPPING CARTON

[75] Inventor: Arthur D. Szabo, Lima, Ohio

[73] Assignee: Westinghouse Electric Corp., Pittsburgh, Pa.

[21] Appl. No.: 153,989

[22] Filed: May 28, 1980

[51] Int. Cl.[3] ..... B65D 81/02; B65D 85/68

[52] U.S. Cl. ..... 206/319; 206/521; 206/591

[58] Field of Search ..... 206/319, 591, 521, 446

[56] References Cited

U.S. PATENT DOCUMENTS

| | | | |
|---|---|---|---|
| 2,046,562 | 7/1936 | Kane et al. | 206/446 |
| 2,314,491 | 3/1943 | Greenberg | 206/319 |
| 2,410,591 | 11/1946 | Turner | 206/591 |
| 2,477,512 | 7/1949 | Dunneback | 206/319 |
| 2,546,921 | 3/1951 | Dunneback | 206/319 |
| 2,733,851 | 2/1956 | Van Ness | 206/319 |

*Primary Examiner*—William T. Dixson, Jr.
*Attorney, Agent, or Firm*—G. H. Telfer

[57] ABSTRACT

A motor and shipping carton combination is provided in which the carton is folded from the unitary piece of packaging material and includes an end portion comprising flaps joined with bottom and side portions including one such flap that is further folded to provided an inwardly extending shoulder, a downwardly extending wall and a bottom portion bonded to the carton bottom wherein the wall restrains the frame of the motor against axial movement while the motor shaft extends over the shoulder and is limited from substantial contact with the end of the carton.

6 Claims, 3 Drawing Figures

ELECTRIC MOTOR SHIPPING CARTON

BACKGROUND AND SUMMARY OF THE INVENTION

This invention relates to electric motor packaging and particularly to fractional horsepower motors with a shaft extension in a package accommodating and restraining movement of the motor with a minimum of packaging material.

Small, fractional horsepower motors have been normally packaged in a corrugated carton of rectilinear configuration with the enclosed space not conforming in any respect to the motor and shaft configuration other than by the six surfaces (top, bottom, two sides, and two ends) of the completed carton. This has normally meant that one or more additional packaging elements have been required to be placed within the carton in order to restrain axial movement of the motor so the shaft does not penetrate an end wall.

For example, an insert such as a cylindrical collar is often used around the shaft with its ends bearing against and spacing the motor frame from the end wall.

It is also the case that normally the carton bottom is formed by flaps extending from the end and side walls with the side wall flaps meeting in the middle and being stapled together with the flaps of the end walls. This manner of joining the bottom of the carton leaves it susceptible to damage by the weight of the motor on the bottom surface thus requiring the use of an additional liner element which is a flat piece of packaging material conforming to the entire bottom as well as the sides and top surfaces of the carton. The cost and assembly time of such carton elements as have been heretofore used is sought to be minimized while improving upon the overall strength of the assembled carton.

The present invention provides a motor in a corrugated carton that is folded from a unitary piece of corrugated packaging material with a unitary bottom surface that does not require stapling or other fastening and is continuous and directly joined to the side surfaces so that an additional liner is not required. Furthermore, one end of the carton is provided with a flap joined at a side edge with one of the side portions, a second flap joined at a part of the side edge with the other of the side portions and the second flap is disposed inwardly and bonded to the first flap. The second flap has a shoulder portion joined to its lower edge with the shoulder extending substantially parallel to the top and bottom portions and joined to a downwardly extending wall portion which is joined to a support portion folded back under the shoulder portion and bonded to the bottom portion so that the wall limits axial movement of the motor frame while the configuration of the wall and shoulder is such that the shaft extends over the shoulder but is not allowed to reach the end surface of the box.

A degree of versatility is provided because the other end of the carton is provided by flaps from the bottom and side portions in a manner that permits the formation of a fold in the flap extending from the bottom portion so that when folded over it provides a greater thickness between the motor frame and that end wall or the flap may be left in its unfolded condition to provide greater clearance within the space enclosed by the carton.

It is preferable to avoid the use of staples or other mechanical fasteners by the use of adhesive bonding between adjacent carton flap surfaces for greater convenience in assembly and strength in the resulting package. Other purposes and advantages of the package motor in accordance with the present invention will be apparent from the following description.

DESCRIPTION OF THE PREFERRED EMBODIMENT

Figure 1:
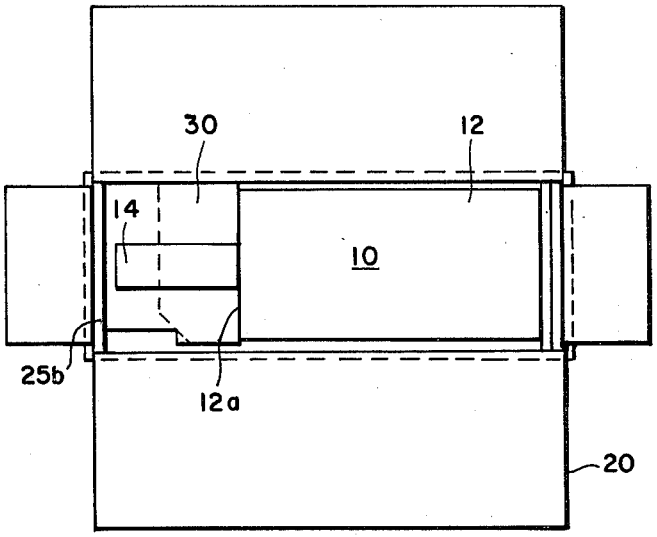
FIG. 1 is a top elevation view of a packaged motor in accordance with an embodiment of the present invention with the top flaps of the carton in the open position.
Figure 2:
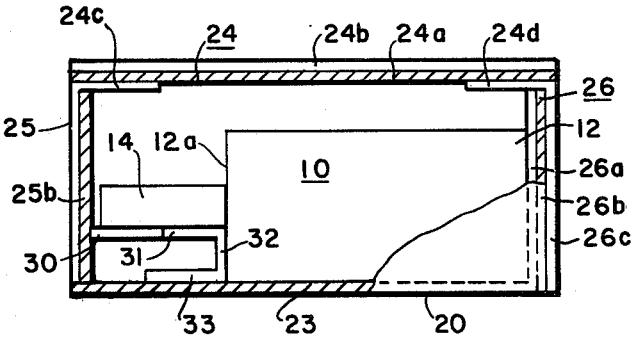
FIG. 2 is a side elevation view of a package motor generally in accordance with FIG. 1, however, with the carton closed and the carton shown in section; and, FIG. 3 is a plan view of a packaging blank in accordance with an embodiment of this invention, before folding, showing the configuration of surfaces and flaps that are cut or folded to form a carton in accordance with FIGS. 1 and 2.
Figure 3:
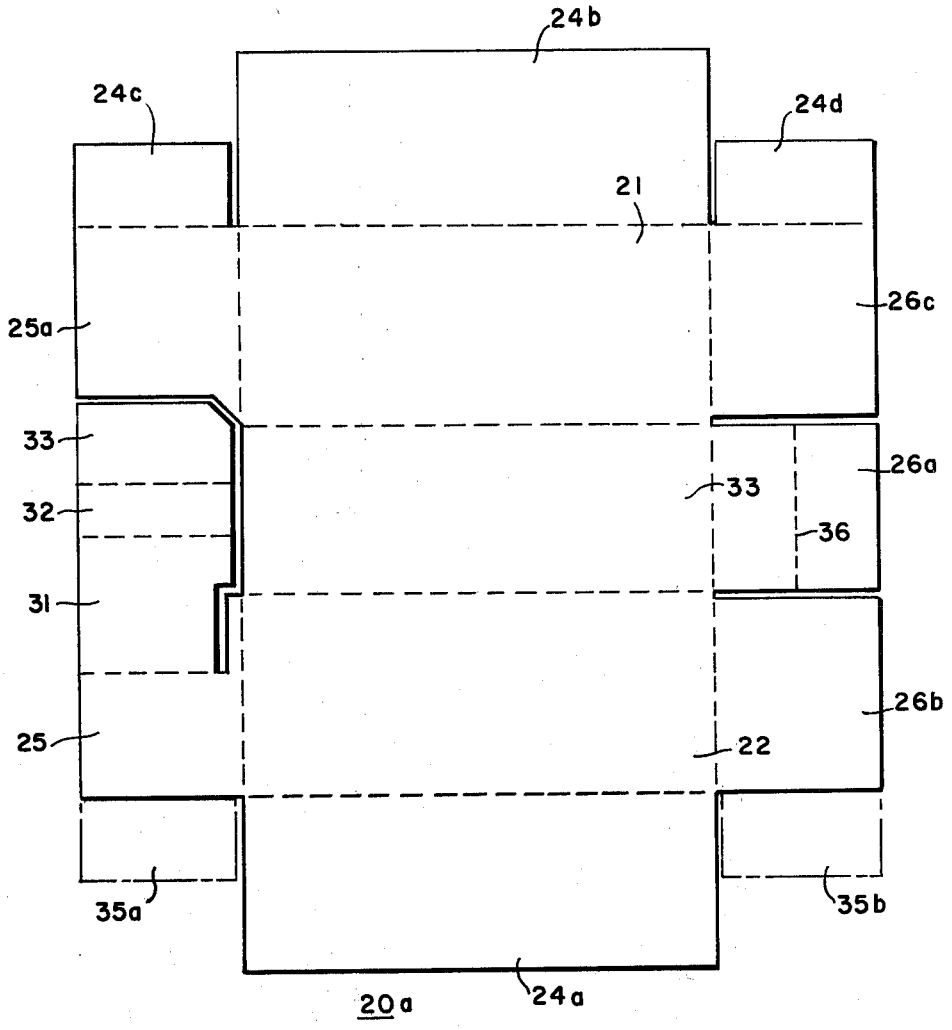

Referring to the drawing, particularly FIGS. 1 and 2, there is shown a motor 10 having the normal characteristics of a fractional horsepower motor including a generally cylindrical frame 12, although the frame may also be substantially rectilinear, with a shaft 14 extending axially from substantially the midpoint of an end 12*a* of the frame. The motor 10 is disposed within a folded carton 20 formed from a corrugated blank 20*a* as configured in accordance with FIG. 3. The carton 20 is of any suitable sheet type packaging material such as corrugated material. The carton 20 comprises first and second side portions 21 and 22, a bottom portion 23, a top portion 24, and first and second end portions 25 and 26 all of which are folded from a unitary piece of packaging material as shown in FIG. 3. In the assembled carton the side portions 21 and 22 and bottom portion 23 are single thicknesses of a continuous part of the packaging material. The end portions 25 and 26 each comprises multiple flaps that are joined at their edges to the bottom and side portions of the carton. Those elements referred to herein as "joined" are preferably of course integrally related and merely have a common folded edge. As shown in FIG. 3, certain lines on the original packaging blank 21*a* are cut while others, indicated by dashed lines are merely scored for folding.

At the first end portion 25 the exterior surface of the carton is provided by a first flap 25*a* joined at the side edge with one of the side portions 21. A second flap 25*b* that is joined on part of a side edge with the other of the two side portions 22 and is separated by the cut from the bottom portion 23 is the element that results in an integral shaft protector referred to generally as element 30. The folding of the second flap 25*b* results in three significant portions including a shoulder portion 31 joined to the second flap end portion 25*b* at its lower edge with the shoulder portion extending substantially parallel to the top and bottom of the carton and joined to the downwardly extending wall portion 32 of 25*b*. The wall 32 in turn is joined to a support portion 33 folded back under the shoulder portion 31 and bonded to the bottom portion 23 of the carton. The configuration is such that the motor frame 12 is accommodated and substantially secured against axial movement by the wall portion 32 and the opposite end portion 26 of the carton while the motor shaft 14 extends over the shoulder portion 31 and is restrained from appreciable contact with the elements of the first end surface 25.

At the second end 26 of the carton the end portion comprises a first flap 26*a* joined at its lower edge to the bottom portion 23, a second flap 26*b* joined at a side edge to one of the side portions 22, and a third flap 26*c* joined at a side edge to the other of the side portions 21 to provide three thicknesses of packaging material. Several options are available as to the utilization of the flaps at the second end 26 so as to permit the carton accommodating motors of different frame lengths. For example, the first flap 26*a* of the second end portion that is joined to the bottom portion is preferably scored along a line 36 running from side to side so that it may be folded over to provide an additional, fourth, thickness between the motor and the outer surface of the carton or, of course, the same element may be left in its full extended unfolded position to accommodate a somewhat larger frame motor. Still further, the provision of the shoulder 31 and wall 32 configuration at the first end 25 of the carton against which the frame 12 bears permits an assembler merely to place a motor in the carton with the frame disposed toward the wall and then utilize what ever elements are necessary to reasonably fill the space at the other end of the motor, including the possible insertion of one or more additional sheets of packaging material. For example, lower corner pieces 35A and 35B which are cut away from the packaging blank may be utilized as additional inserts without incurring additional material cost.

The configuration of the top portion 24 of the carton is relatively simple. It comprises flaps 24*a* and 24*b* joined with each of the side portions and extending substantially across the area of the top portion and flaps 24*c* and 24*d* joined with the side portion flaps 25*a* and 26*c*, respectively. Alternatively, the top flaps 24A and 24B could extend only partly across the top area and be joined together or joined only to flaps 24C and 24D.

It is preferred that the bonding of facing surfaces of the carton be achieved by adhesive bonds rather than by mechanical fasteners such as staples. Adhesive materials are available which can be applied to the carton blank 20*a* in its original form and which are essentially self-bonding when the adjacent surfaces are aligned and pressed together. This achieves a durable strong bond in less time then if staples are used.

It can be seen therefore that the packaged motor in accordance with the present invention does not require a separate shaft protector to restrain the motor from axial movement because such restraint is provided by the wall and shoulder configuration of the first end. Also it is unnecessary to apply a separate liner to the bottom surface of the carton for additional strength because there is a continuous bottom without fasteners. It is optional but generally desirable that an additional element of packaging material be applied over the top of the motor to restrain it against up and down movement. This may be in the form of an arcuate piece of material substantially conforming to the motor frame configuration placed on top of it after the motor is placed in the carton and held in place upon the closure of the top flaps.

In general it will be understood that the invention provides a significant contribution to motor packaging and may take various forms other than those specifically illustrated herein in the provision of the unitary shaft protector elements as exemplified at the first end of the carton illustrated.

I claim:

1. A motor and shipping carton combination comprising:

a motor having a frame and a shaft extending therefrom;

a folded carton having two side portions, a bottom portion, a top portion, and first and second end portions, all of which are folded from a unitary piece of packaging material, a first end portion comprising a first flap joined at a side edge thereof with one of said side portions, a second flap joined on part of a side edge thereof with the other of said two side portions, said second flap disposed inwardly and bonded to said first flap, and said second flap having a shoulder portion joined thereto at the lower edge thereof, said shoulder portion extending substantially parallel to said top and bottom portions and joined to a downwardly extending wall portion which in turn is joined to a support portion folded back under said shoulder portion and bonded to said bottom portion;

said motor frame being contained within and secured against substantial axial movement by said wall portion associated with said second flap of said first end portion and by said second end portion;

said motor shaft being disposed over said shoulder portion and kept by the restraint on said frame from contact with said second flap of said first end portion.

2. A motor and shipping carton combination in accordance with claim 1 wherein:

said second end portion comprises a first flap joined at its lower edge to said bottom portion, a second flap joined at a side edge to one of said side portions, and a third flap joined at a side edge to the other of said side portions to provide three thicknesses of packaging material in said second end portion.

3. A motor and shipping carton combination in accordance with claim 2 wherein:

said first flap of said second end portion is disposed inwardly of said second and third flaps and said second and third flaps are adhesively bonded together.

4. A motor and shipping carton combination in accordance with claim 3 wherein:

said first flap of said second end portion is folded on itself on a line running from side to side to form a forth thickness of packaging material in said second end portion.

5. A motor and shipping carton combination in accordance with claim 1 wherein:

said support portion of said second flap is bonded to said bottom portion by adhesive, and adhesive bonds are also provided between said first and second flaps of said first end portion, between two flaps of said second end portion that are respectively joined to said two side portions, and between two flaps of said top portion that are respectively joined to said two side portions to complete said carton without the use of mechanical fasteners.

6. A motor shipping carton comprising:

two side portions, a bottom portion, a top portion, and first and second end portions, all of which are folded from the unitary piece of packaging material;

a first end portion comprising a first flap joined at a side edge thereof with one of said side portions, a second flap joined on part of the side edge thereof with the other of said two side portions, said second flap disposed inwardly and bonded to said first flap and second flap having a shoulder portion joined thereto at the lower edge thereof;

said shoulder portion extending substantially parallel to said top and bottom portions and joined to a downwardly extending wall portion which in turn is joined to a support portion folded back under said shoulder portion and bonded to said bottom portion wherein said wall portion provides restraint against axial movement of a contained motor while the space above said shoulder portion accommodates the motor shaft.

* * * * *